US008011187B2

(12) United States Patent
Sprouse et al.

(10) Patent No.: US 8,011,187 B2
(45) Date of Patent: Sep. 6, 2011

(54) FUEL INJECTION METHOD AND APPARATUS FOR A COMBUSTOR

(75) Inventors: Kenneth M Sprouse, Northridge, CA (US); Shahram Farhangi, Woodland Hills, CA (US); Alan V. von Arx, Northridge, CA (US); David R. Matthews, Simi Valley, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 1400 days.

(21) Appl. No.: 11/515,959

(22) Filed: Sep. 5, 2006

(65) Prior Publication Data

US 2007/0039326 A1 Feb. 22, 2007

Related U.S. Application Data

(62) Division of application No. 10/729,679, filed on Dec. 5, 2003, now Pat. No. 7,140,184.

(51) Int. Cl.
*F02C 1/00* (2006.01)
*F02G 3/00* (2006.01)

(52) U.S. Cl. ..... 60/740; 239/499; 60/737

(58) Field of Classification Search ..... 60/740, 60/742, 743, 746, 747, 737; 239/499, 504, 239/518, 521, 524, 432
See application file for complete search history.

(56) References Cited

U.S. PATENT DOCUMENTS

| | | | | | |
|---|---|---|---|---|---|
| 1,688,827 | A * | 10/1928 | Nelson | 239/427 |
| 2,755,135 | A * | 7/1956 | Gusching | 239/524 |
| 3,736,746 | A * | 6/1973 | DuBell et al. | 60/804 |
| 3,785,572 | A * | 1/1974 | Arnold et al. | 239/518 |
| 3,961,475 | A * | 6/1976 | Wood | 60/738 |
| 4,265,615 | A * | 5/1981 | Lohmann et al. | 431/353 |
| 4,349,156 | A * | 9/1982 | Haruch et al. | 239/432 |
| 4,350,009 | A * | 9/1982 | Holzapfel | 60/39.23 |
| 4,497,664 | A * | 2/1985 | Verry | 134/22.12 |
| 4,815,665 | A * | 3/1989 | Haruch | 239/432 |
| 5,054,688 | A * | 10/1991 | Grindley | 239/407 |
| 5,137,214 | A * | 8/1992 | Mallery | 239/11 |
| 5,351,477 | A * | 10/1994 | Joshi et al. | 60/39.463 |
| 5,439,714 | A * | 8/1995 | Mori et al. | 427/446 |
| 5,675,971 | A * | 10/1997 | Angel et al. | 60/746 |
| 5,778,676 | A * | 7/1998 | Joshi et al. | 60/746 |
| 6,613,195 | B2 * | 9/2003 | Anderson | 162/289 |
| 6,732,527 | B2 * | 5/2004 | Freeman et al. | 60/737 |
| 7,469,544 | B2 * | 12/2008 | Farhangi | 60/740 |
| 7,506,510 | B2 * | 3/2009 | Thomson | 60/740 |
| 7,533,532 | B1 * | 5/2009 | Toon et al. | 60/740 |
| 7,611,072 | B2 * | 11/2009 | Peters et al. | 239/13 |
| 7,669,420 | B2 * | 3/2010 | Spooner | 60/743 |
| 7,762,073 | B2 * | 7/2010 | Li et al. | 60/748 |
| 2009/0199561 | A1 * | 8/2009 | Hessler | 60/734 |

* cited by examiner

*Primary Examiner* — William Rodriguez
(74) *Attorney, Agent, or Firm* — Carlson Gaskey & Olds PC

(57) ABSTRACT

A combustor and injector system to inject a selected fuel into a combustor of a gas powered turbine. Generally, the injector is able to inject a selected fuel into a stream of an oxidizer to substantially mix the fuel with the oxidizer stream before any of the fuel in the fuel fan reaches an auto ignition temperature. Therefore the fuel may be substantially combusted at once and without any substantial hot spots.

11 Claims, 6 Drawing Sheets

FUEL INJECTION METHOD AND APPARATUS FOR A COMBUSTOR

CROSS-REFERENCE TO RELATED APPLICATIONS

This application is a divisional of U.S. patent application Ser. No. 10/729,679, filed Dec. 5, 2003 now U.S. Pat. No. 7,140,184, issued Nov. 28, 2006. The disclosure of the above application is hereby incorporated by reference.

FIELD

The present disclosure relates generally to gas powered turbines for generating power, and more particularly to a low nitrous oxide emission combustion system for gas powered turbine systems.

BACKGROUND

It is generally known in the art to power turbines with gases being expelled from combustion chambers. These gas powered turbines can produce power for many applications such as terrestrial power plants. In the gas powered turbine a fuel, such as a hydrocarbon (for example methane or kerosene) or hydrogen, is combusted in an oxygen rich environment. Generally, these combustion systems have high emissions of undesirable compounds such as nitrous oxide compounds (NOX) and carbon containing compounds. It is generally desirable to decrease these emissions as much as possible so that undesirable compounds do not enter the atmosphere. In particular, it has become desirable to reduce NOX emissions to a substantially low amount. Emissions of NOX are generally desired to be non-existent, and are accepted to be non-existent, if they are equal to or less than about one part per million volume of dry weight emissions.

In a combustion chamber fuel, such as methane, is combusted in atmospheric air where temperatures generally exceed about 1427° C. (about 2600° F.). When temperatures are above 1427° C., the nitrogen and oxygen compounds, both present in atmospheric air, undergo chemical reactions which produce nitrous oxide compounds. The energy provided by the high temperatures allows the breakdown of dinitrogen and dioxygen, especially in the presence of other materials such as metals, to produce NOX compounds such as $NO_2$ and NO.

It has been attempted to reduce NOX compounds by initially heating the air before it enters the combustion chambers to an auto-ignition temperature. If the air enters the combustion chamber at an auto-ignition temperature, then no flame is necessary to combust the fuel. Auto-ignition temperatures are usually lower than pilot flame temperatures or the temperatures inside recirculation flame holding zones. If no flame is required in the combustion chamber, the combustion chamber temperature is lower, at least locally, and decreases NOX emissions. One such method is to entrain the fuel in the air before it reaches the combustion chamber. This vitiated air, that is air which includes the fuel, is then ignited in a pre-burner to raise the temperature of the air before it reaches the main combustion chamber. This decreases NOX emissions substantially. Nevertheless, NOX emissions still exist due to the initial pre-burning. Therefore, it is desirable to decrease or eliminate this pre-burning, thereby substantially eliminating all NOX emissions.

Although the air is heated before entering the main combustion chamber, it may still be ignited in the combustion chamber to combust the remaining fuel. Therefore, an additional flame or arc is used to combust remaining fuel in the main combustion chamber. This reduces the temperature of the igniter, but still increases the temperature of the combustion chamber. In addition, no fuel is added to the air as it enters the combustion chamber. Rather all the fuel has already been entrained in the air before it enters the combustion chamber to be combusted. This greatly reduces control over where combustion occurs and the temperature in the combustion chamber Other attempts to lower NOX emissions include placing catalysts in catalytic converters on the emission side of the turbines. This converts the NOX compounds into more desirable compounds such as dinitrogen and dioxygen. These emission side converters, however, are not one hundred percent efficient thereby still allowing NOX emissions to enter the atmosphere. The emission converters also use ammonia $NH_3$, gas to cause the reduction of NOX to $N_2$. Some of this ammonia is discharged into the atmosphere. Also, these converters are expensive and increase the complexity of the turbine and power production systems. Therefore, it is also desirable to eliminate the need for emission side catalytic converters.

SUMMARY

The present disclosure is directed to a combustor and a combustion chamber for a gas powered turbine. A heat exchanger and a pre-combustor, such as a catalyst, combust a first portion of fuel intermixed with air without the production of undesired chemical species. The gas powered turbine requires expanding gases to power the turbine fans or blades. Fuel is generally combusted to produce the required gases. A catalyst may be employed to lower the combustion temperature of the fuel. The catalyst is placed on a portion of tubes in a heat exchanger such that a portion of the thermal energy may be transferred to the air before it engages the catalyst. After encountering the catalyst, the fuel that was combusted increases the temperature of the air to an auto-ignition or hypergolic temperature of a fuel so that no other ignition source is needed to combust additional fuel added later. Therefore, as the air exits the heat exchanger, it enters a main combustion chamber, is mixed with a second portion of the fuel where it is auto-ignited and burned.

The fuel may be injected into the main combustion chamber in any appropriate manner. Generally, a fuel may be injected through an injector that allows the fuel to mix with a selected oxidizer stream in a manner that allows the fuel to combust without a separate ignition source. For example, the fuel may be injected from a fuel source onto a splash plate that allows the fuel to splash or expand in a selected manner, such as forming a sheet, to substantially mix with the oxidizer stream.

Further areas of applicability of the present disclosure will become apparent from the detailed description provided hereinafter. It should be understood that the various embodiments described are intended for purposes of illustration only and are not intended to limit the scope of the invention.

BRIEF DESCRIPTION OF THE DRAWINGS

The present disclosure will become more fully understood from the detailed description and the accompanying drawings, wherein.

DETAILED DESCRIPTION OF VARIOUS EMBODIMENTS

The following description of various embodiments is merely exemplary in nature and is in no way intended to limit the present disclosure, its application, or uses. Specifically, although the following combustor is described in conjunction with a terrestrial gas powered turbine, it may be used in other systems. Furthermore, the mixer and heat exchanger may be used in systems other than turbine systems.

Figure 1:
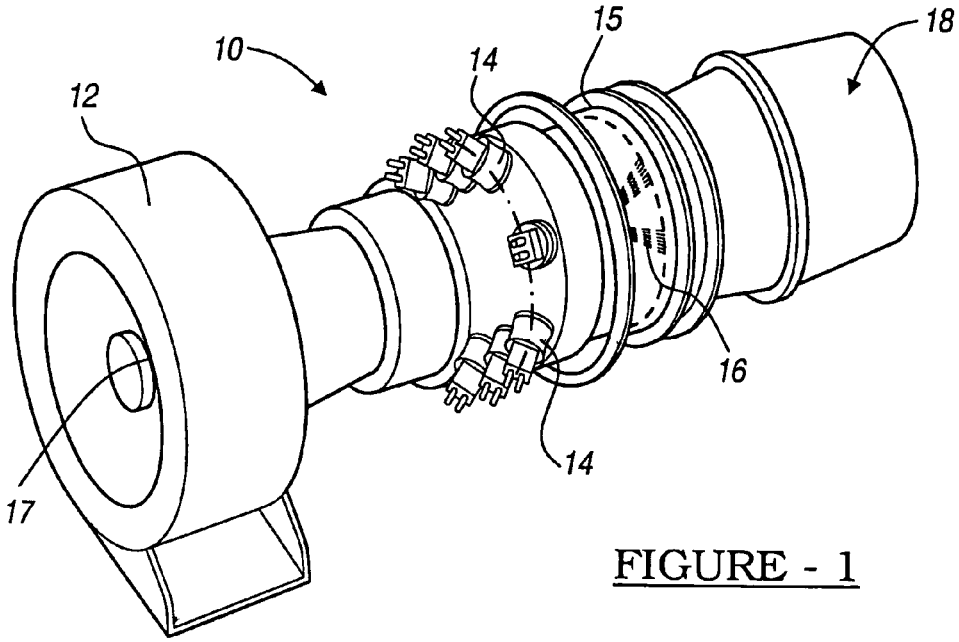
FIG. 1 is a perspective view of a gas powered turbine including a combustor in accordance with an embodiment of the present disclosure.

Referring to FIG. 1, a gas powered turbine in accordance with an embodiment of the present disclosure is shown. The gas powered combustion turbine 10 may use several different liquid or gaseous fuels, such as hydrocarbons (including methane, propane and natural gas), hydrogen, and Synthesis gas that are combusted and that expand to move portions of the gas powered turbine 10 to produce power. An important component of the gas powered turbine 10 is a compressor 12 which forces atmospheric air into the gas powered turbine 10. Also, the gas powered turbine 10 includes several combustion chambers 14 for combusting fuel. The combusted fuel is used to drive a turbine 15 including turbine blades or fans 16 which are axially displaced in the turbine 15. There are generally a plurality of turbine fans 16, however, the actual number depends upon the power the gas powered turbine 10 is to produce. Only a single turbine fan is illustrated for clarity.

In general, the gas powered turbine 10 ingests atmospheric air, combusts a fuel in it, which powers the turbine fans 16. Essentially, air is pulled in and compressed with the compressor 12, which generally includes a plurality of concentric fans which grow progressively smaller along the axial length of the compressor 12. Although general atmospheric air may be the oxidizer, any other appropriate oxidizer may be used. The fans in the compressor 12 are all powered by a single axle. The high pressure air then enters the combustion chambers 14 where fuel is added and combusted. Once the fuel is combusted, it expands out of the combustion chamber 14 and engages the turbine fans 16 which, due to aerodynamic and hydrodynamic forces, spins the turbine fans 16. The gases form an annulus that spin the turbine fans 16, which are affixed to a shaft (not shown). Generally, there are at least two turbine fans 16. One or more of the turbine fans 16 engage the same shaft that the compressor 12 engages.

The gas powered turbine 10 is self-powered since the spinning of the turbine fans 16 also powers the compressor 12 to compress air for introduction into the combustion chambers 14. Other turbine fans 16 are affixed to a second shaft 17 which extends from the gas powered turbine 10 to power an external device. After the gases have expanded through the turbine fans 16, they are expelled out through an exhaust port 18. It will be understood that the gas powered turbines are used for many different applications such as engines for vehicles and aircraft or for power production in a terrestrially based gas powered turbine 10.

The gases which are exhausted from the gas powered turbine 10 include many different chemical compounds that are created during the combustion of the atmospheric air in the combustion chambers 14. If only pure oxygen and pure hydrocarbon fuel were combusted, absolutely completely and stoichiometrically, then the exhaust gases would include only carbon dioxide and water. Atmospheric air, however, is not 100% pure oxygen and includes many other compounds such as nitrogen and other trace compounds. Therefore, in the high energy environment of the combustion chambers 14, many different compounds may be produced. All of these compounds exit the exhaust port 18.

It is generally known in the art that an equivalence ratio is determined by dividing the actual ratio of fuel and air by a stoichiametric ratio of fuel to air (where there is not an excess of one starting material). Therefore, a completely efficient combustion of pure fuel and oxygen air would equal an equivalence ratio of one. It will be understood that although atmospheric air in a hydrocarbon fuel may be preferred for economic reasons, other oxidizers and fuels may be provided. The air simply provides an oxidizer for the fuel.

It will also be understood that the gas powered turbine 10 may include more than one combustion chamber 14. Any reference to only one combustion chamber 14, herein, is for clarity of the following discussion alone. The system and method of the present disclosure may be used with any oxidizer or fuel which is used to power the gas powered turbine 10. Moreover, the combustor 14 may combine any appropriate fuel. Air is simply an exemplary oxidizer and hydrocarbons an exemplary fuel.

Figure 2:
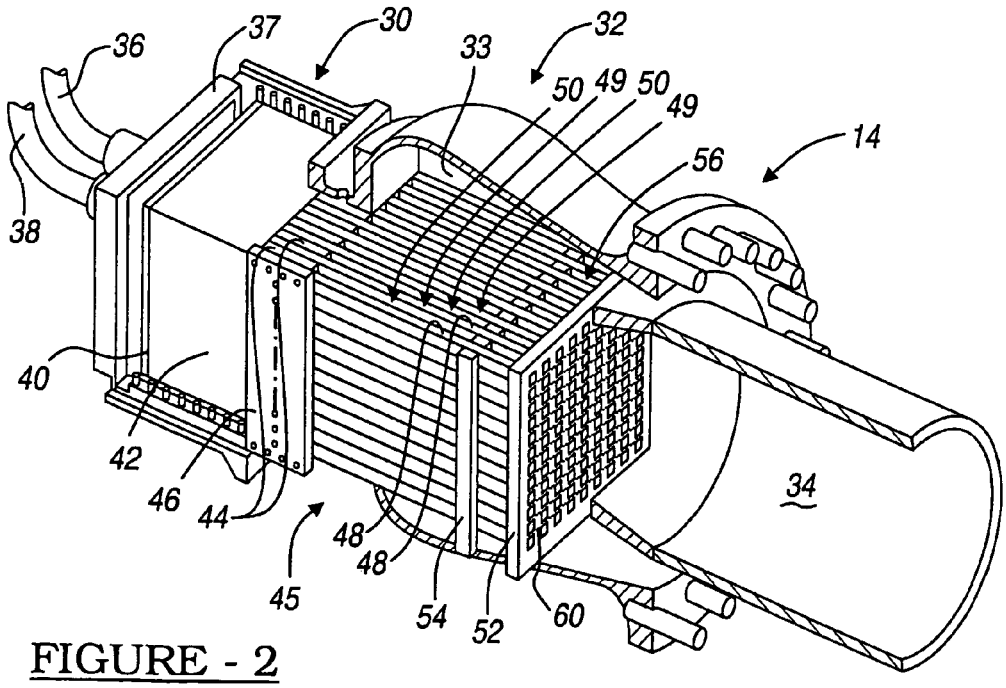
FIG. 2 is a partial cross-sectional perspective view of a single combustor.

With reference to FIG. 2, an exemplary combustion chamber 14 is illustrated. The combustion chamber may comprise any appropriate combustion chamber such as the one described in U.S. patent application Ser. No. 10/397,394 filed Mar. 26, 2003 entitled, "A Catalytic Combustor and Method for Substantially Eliminating Nitrous Oxide Emissions," incorporated herein by reference. The combustion chamber 14 includes a premix section or area 30, a heat exchange or pre-heat section 32, generally enclosed in a heat exchange chamber 33, and a main combustion section 34. A first or premix fuel line 36 provides fuel to the premix area 30 through a fuel manifold 37 while a second or main fuel line 38 provides fuel to the main combustion section 34 through a main injector 52. Positioned in the premix area 30 is a premix injector 40 which injects fuel from the first fuel line 36 into a premix chamber or premixer 42. Air from the compressor 12 enters the premix area 30 through a plurality of cooling tubes 44 of a heat exchanger or pre-heater 45 (detailed in FIG. 3). The premix chamber 42 encompasses a volume between the premix injector 40 and the exit of the cooling tubes 44.

With further reference to FIG. 2, a plurality of heat exchange or catalyst tubes 48 extend into the heat exchange area 32. The heat exchange tubes 48 are spaced laterally apart. The heat exchange tubes 48, however, are not spaced vertically apart. This configuration creates a plurality of columns 49 formed by the heat exchange tubes 48. Each heat exchange tube 48, and the column 49 as a whole, defines a pathway for air to travel through. The columns 49 define a plurality of channels 50. It will be understood this is simply exemplary and the tubes 48 may be spaced in any configuration to form the various pathways. Extending inwardly from the walls of the heat exchange chamber 33 may be directing fins (not particularly shown). The directing fins direct the flow of air to the top and the bottom of the heat exchange chamber 33 so that air is directed to flow vertically through the channels 50 defined by the heat exchange tubes 48.

Near the ends of the heat exchange tubes 48, where the heat exchange tubes 48 meet the main combustion section 34, is a main injector 52. The second fuel line 38 provides fuel to the main injector 52 so that fuel may be injected at the end of each heat exchange tube 48. Spaced away from the main injector 52, towards the premix area 30, is an intra-propellant plate 54. The intra-propellant plate 54 separates the air that is traveling through the channels 50 and the fuel that is being fed to the fuel manifold region 56 between the main injector face 52 and intra-propellant plate 54. It will be understood, that the intra-propellant plate 54 is effectively a solid plate, though not literally so in this embodiment. The placement of the heat exchange tubes 48 dictate that the intra-propellant plate 54 be segmented wherein one portion of the intrapropellant plate 54 is placed in each channel 50 between two columns 49.

Air which exits out the heat exchange tubes 48 is entrained with fuel injected from an injector port 60, according to various embodiments that being the main injector 52, and this fuel then combusts in the main combustion section 34. The main combustion section 34 directs the expanding gases of the combusted fuel to engage the turbine fans 16 so that the expanded gases may power the turbine fans 16.

Figure 3:
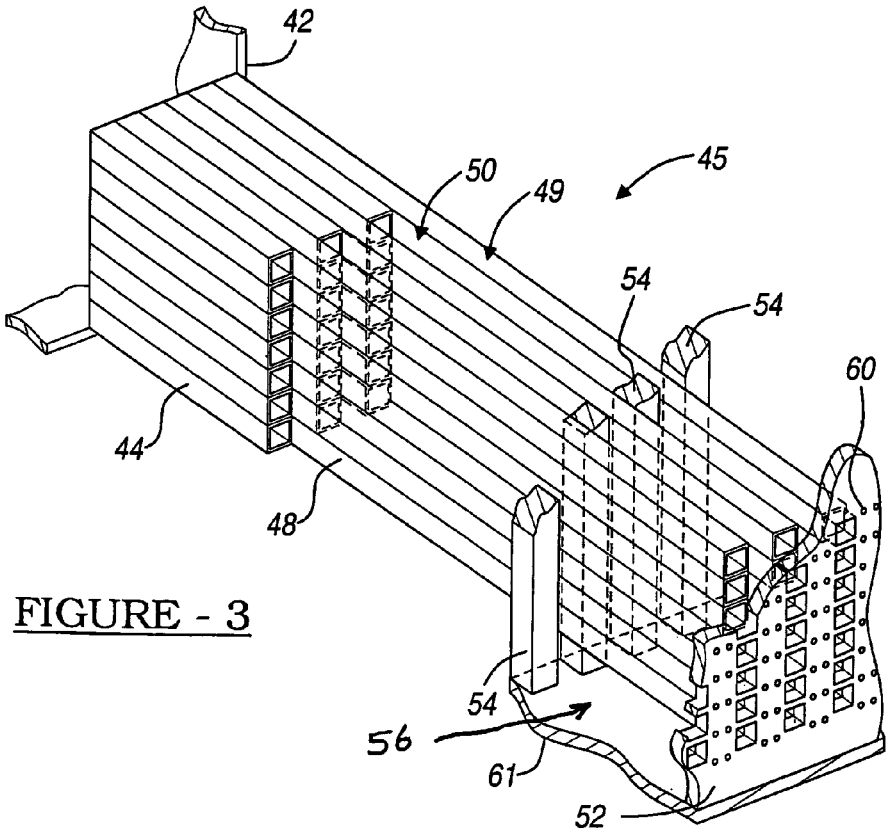
FIG. 3 is a detailed, partial cross-sectional, perspective view of a portion of the heat exchanger.

Turning reference to FIG. 3, a detailed portion of the heat exchanger 45 is illustrated. Although, in one embodiment, the heat exchanger 45 includes a large plurality of tubes, as generally shown in FIG. 2, only a few of the heat exchange tubes 48 and cooling tubes 44 are illustrated here for greater clarity. The heat exchanger 45 may be similar to the heat exchanger described in U.S. Pat. No. 5,309,637 entitled "Method of Manufacturing A Micro-Passage Plate Fin Heat Exchanger", incorporated herein by reference. The heat exchanger 45 includes a plurality of cooling tubes 44 disposed parallel to and closely adjacent the heat exchange tubes 48. Each of the cooling tubes 44 and the heat exchange tubes 48 have a generally rectangular cross section and can be made of any generally good thermally conductive material. Preferably, the heat exchange tubes 48 and the cooling tubes 44 are formed of stainless steel. It will be appreciated that while the cooling tubes 44 and the heat exchange tubes 48 are shown as being substantially square, the cross-sectional shape of the components could comprise a variety of shapes other than a square shape. It is believed, however, that the generally square shape will provide the best thermal transfer between the tubes 44 and 48.

Both the cooling tubes 44 and the heat exchange tubes 48 may be of any appropriate size, but preferably each are generally square having a width and height of between about 0.04 inches and about 1.0 inches (between about 0.1 centimeters and about 2.5 centimeters). The thickness of the walls of the cooling tubes 44 and the heat exchange tubes 48 may be any appropriate thickness. The walls need to be strong enough to allow the fluids to flow through them, but still allow for an efficient transfer of heat between the inside of the heat exchange tubes 48 and the air in the channels 50 and cooling tubes 44. The thickness may also vary by size and material choice.

The cooling tubes 44 extend parallel to the heat exchange tubes 48 for a portion of the length of the heat exchange tubes 48. Generally, each of the cooling tubes 44 is brazed to one of the heat exchange tubes 48 for the distance that they are placed adjacent one another. Moreover, the cooling tubes 44 and the heat exchange tubes 48 may be brazed to one another. The cooling tubes 44 extend between the columns 49 of the heat exchanger tubes 48. According to various embodiments, brazing materials are those with melting temperatures above about 538° C. (about 1000° F.). The cooling tubes 44 extend between the columns 49 of the heat exchanger tubes 48. The cooling tubes 44 and the heat exchange tubes 48, when brazed together, form the heat exchanger 45 which can provide a surface-to-surface exchange of heat. It will be understood, however, that air traveling in the channels 50 between the heat exchange tubes 48 will also become heated due to the heat transferred from the heat exchange tubes 48 to the air in the channels 50.

Referring further to FIG. 3, fuel injector ports 60 are formed in the main injector 52. The injector ports 60 may be provided in any appropriate number. According to various embodiments, there is a number ratio of heat exchange tubes 48 to injectors 60 of 4:1. There may also be an area ratio of about 1:2. It will be understood, however, that any appropriate ratio of the injectors 60 to the heat exchange tubes 48 may be provided. The fuel is provided to the manifold region 56 which is bound by the intra-propellant plate 54, the main injector plate 52, and a manifold plate 61. The manifold plate 61 may underlay, overlay, or surround the manifold region 56. This provides fuel to each of the injector ports 60 without requiring an individual fuel line to each injector port 60. Therefore, as air exits each heat exchange tube 48, fuel is injected from the injector port 60 to the stream of air emitted from each heat exchange tube 48. In this way, the fuel can be very efficiently and quickly distributed throughout the air flowing from the heat exchanger 45, as discussed further herein.

On the interior walls of each heat exchange tube 48 is disposed a coating of a catalyst. The catalyst may be any appropriate catalyst that is able to combust a hydrocarbon fuel, and may include, for example, platinum, palladium, or mixtures thereof. The catalyst is able to combust a hydrocarbon fuel, such as methane, without the presence of a flame or any other ignition source. The catalyst is also able to combust the fuel without generally involving any side reactions. Therefore, the combustion of fuel does not produce undesired products. It will be understood that if the fuel is not a hydrocarbon then a different, appropriate catalyst is used. The catalyst allows combustion of the fuel without an additional heat source.

Figure 4:
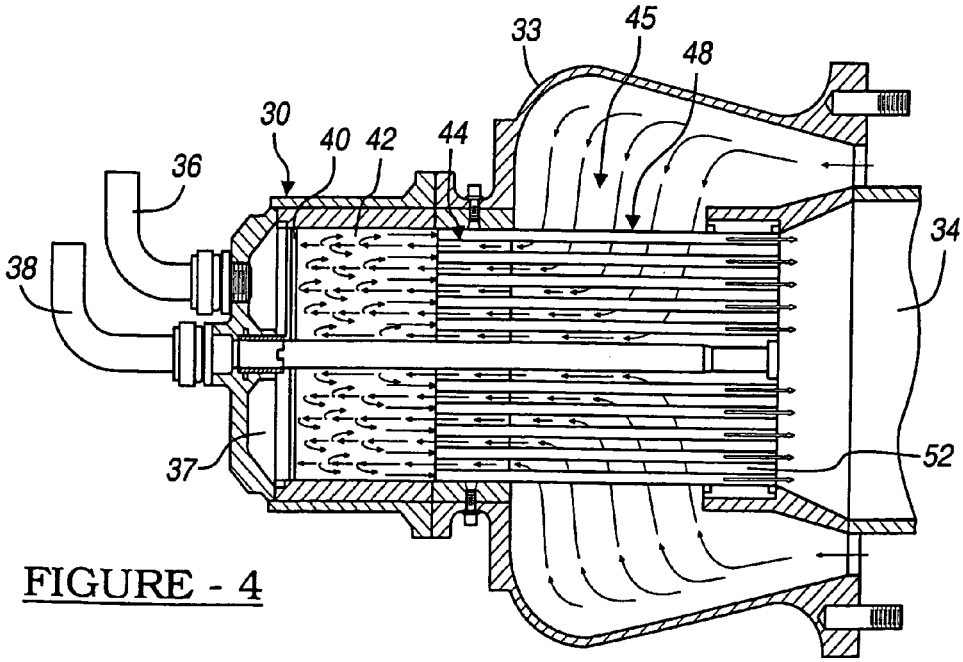
FIG. 4 is a simplified diagrammatic view of the flow of air through the combustion chamber according to a first embodiment.

With continuing reference to FIGS. 1-3 and further reference to FIG. 4, a method of using the combustion chamber 14 according to various embodiments will be described. The combustor 14 includes a pre-mixer 42 which may be formed in any appropriate manner. The pre-mixer 42 may include an open region, as illustrated in FIG. 4, or may include a plurality of the cooling tubes 44 (not particularly illustrated). When an open region is used as the pre-mixer 42 the flow generally follows the path indicated by the arrows in FIG. 4. It will also be understood that a plurality of tubes, as described above, are present in the heat exchanger 45, but have been removed for clarity in the present description of the air flow. Atmospheric air is compressed in the compressor 12 and then introduced into the heat exchange chamber 33 at a high pressure. The air that enters the heat exchange chamber 33 is directed by the directing fins to the top and bottom of the heat exchange chamber 33 so that the air may flow through the channels 50. The air that enters the heat exchange chamber 33 may be at a temperature of about 37° C. to about 427° C. (about 100° F. and about 800° F.). Generally, however, the air enters the heat exchanger 45 at a temperature of about 204° C. to about 400° C. (about 400° F. to about 750° F.).

As the air travels in the channels 50, the air increases in temperature to become "hot" air. The hot air flows through the pathway formed by the cooling tubes 44 and into the premix area 30. The hot air also receives thermal energy while flowing through the cooling tubes 44. It will be understood that the cooling tubes 44 are adjacent a portion of the heat exchange tubes 48. The temperature of the hot air, as it enters the premix area 30, is about 427° C. to about 538° C. (about 800° F. and about 1000° F.). It will be understood that the hot air may be any appropriate temperature, such as the auto-ignition temperature of the selected fuel. The air in the premix area 30 makes a turn within the premix chamber 42. As the air turns inside the premix chamber 42, the premix injector 40 injects fuel into the air, entraining the fuel in the air. About 10% to about 60% of all the fuel used to power the gas powered turbine 10 is entrained in this manner in the premix chamber 42.

After the air enters the premix chamber 42, it then flows out through the pathway formed by the heat exchange tubes 48. In the heat exchange tubes 48, the fuel in the air combusts as it engages the catalyst which is disposed on the inside walls of the heat exchange tubes 48. The catalyst may be disposed within the heat exchange tube 48 in a plurality of ways such as coating by painting or dipping or by affixing seals to the internal walls. As the fuel combusts, the temperature of the air rises to about 768° C. to about 930° C. (about 1400° F. to about 1700° F.). As the temperature of the air rises, it becomes highly energetic to form high energy air, further the high energy air exits the heat exchange tubes 48. The temperature the high energy air reaches in the heat exchange tubes 48 is at least the hypergolic or auto-ignition temperature of the fuel being used in the gas powered turbine 10. This may be any appropriate temperature and may depend on the fuel used. Therefore, the high energy air that exits the heat exchange tubes 48 is, and may also be referred to as, hypergolic or auto ignition air. The auto-ignition temperature of the air is the temperature that the air may be at or above so that when more fuel is injected into the hypergolic air the fuel ignites automatically without any other catalyst or ignition source.

Figure 5:
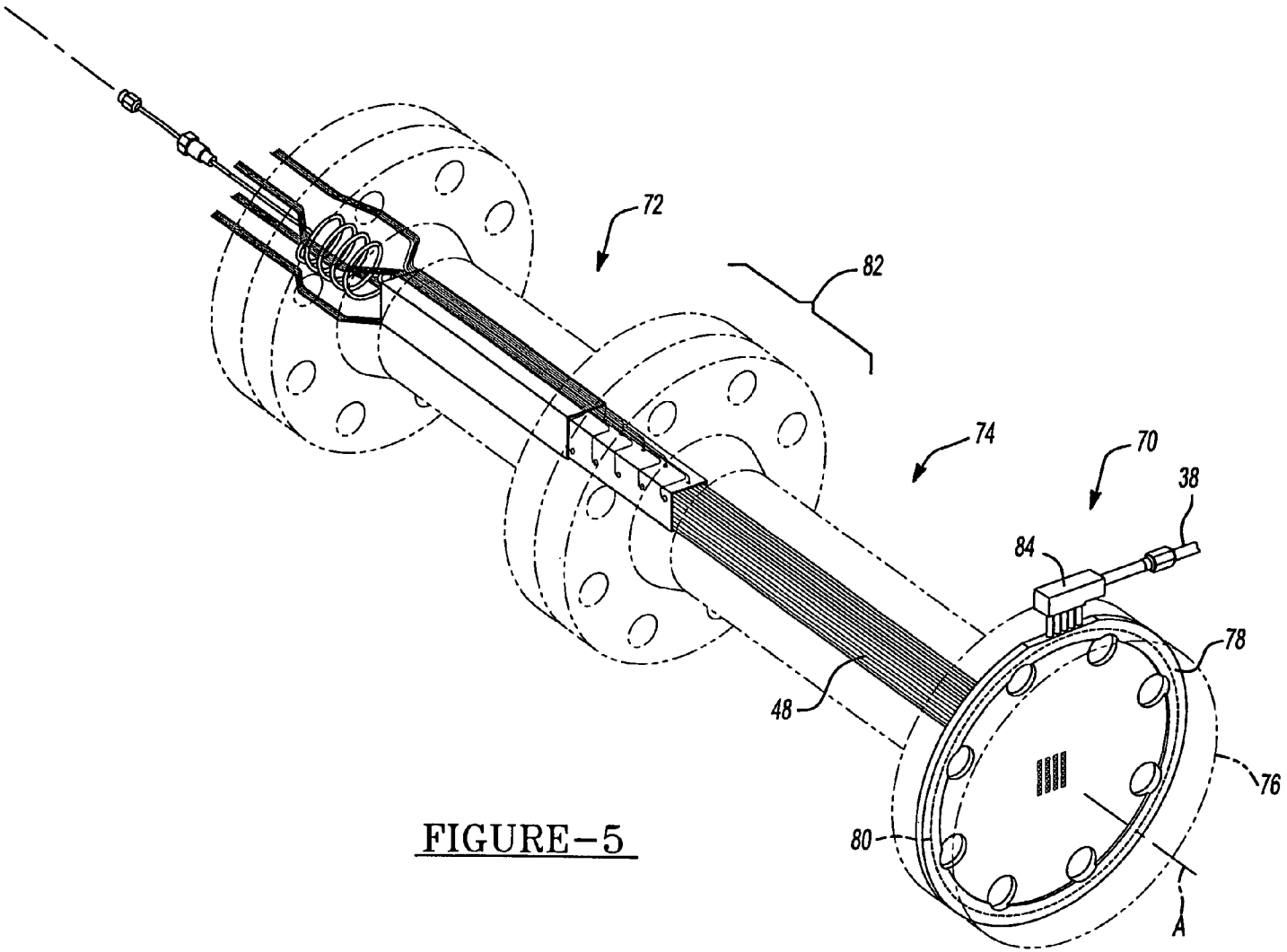
FIG. 5 is a combustor accordingly to an alternative embodiment.

With reference to FIG. 5, a combustor assembly 70 according to various embodiments is illustrated. The combustor assembly 70 is generally oriented along a central axis A. The combustor assembly 70 may include a pre-mix section 72, a pre-combustion or catalyst section 74, and a main combustion chamber or area 76. The main combustion chamber 76 is generally positioned downstream of an injector plate 78. The injector plate 78 may be at least removable from the combustor assembly 70 for easy changing and testing. The heat exchange tubes 48 also provide a pathway for the hot oxidizer or hypergolic air, or air that becomes hypergolic, before it exits the main injector plate 78. Nevertheless, the heat exchange tubes 48 generally are interconnected with the main injector plate 78 or a seal 80 to which the heat exchange tubes 48 are substantially brazed or fixed. The remaining portions of the combustor assembly 70 are substantially similar to the portions illustrated in FIG. 2.

The selected oxidizer and a first portion of the fuel is mixed in the pre-mix section 72, in an area of overlap or heat exchange that is formed where the cooling tubes 44 overlap the heat exchange tubes 48 in an overlap section 82. Although the shape of the combustor 70 may be different than the shape of the combustor 14 illustrated in FIG. 2, the purpose and operation may be substantially similar. Nevertheless, the main injector plate 78 may be easily removed from the combustor assembly 70 due to a local main fuel injection port 84. The main fuel line 38 is interconnected to the main injector plate 78 through the fuel supply port 84. Therefore, rather than supplying the fuel through the center of the combustor 70, the fuel is provided near the main injector plate 78 for easy removal of the main injector plate 78.

Figure 6:
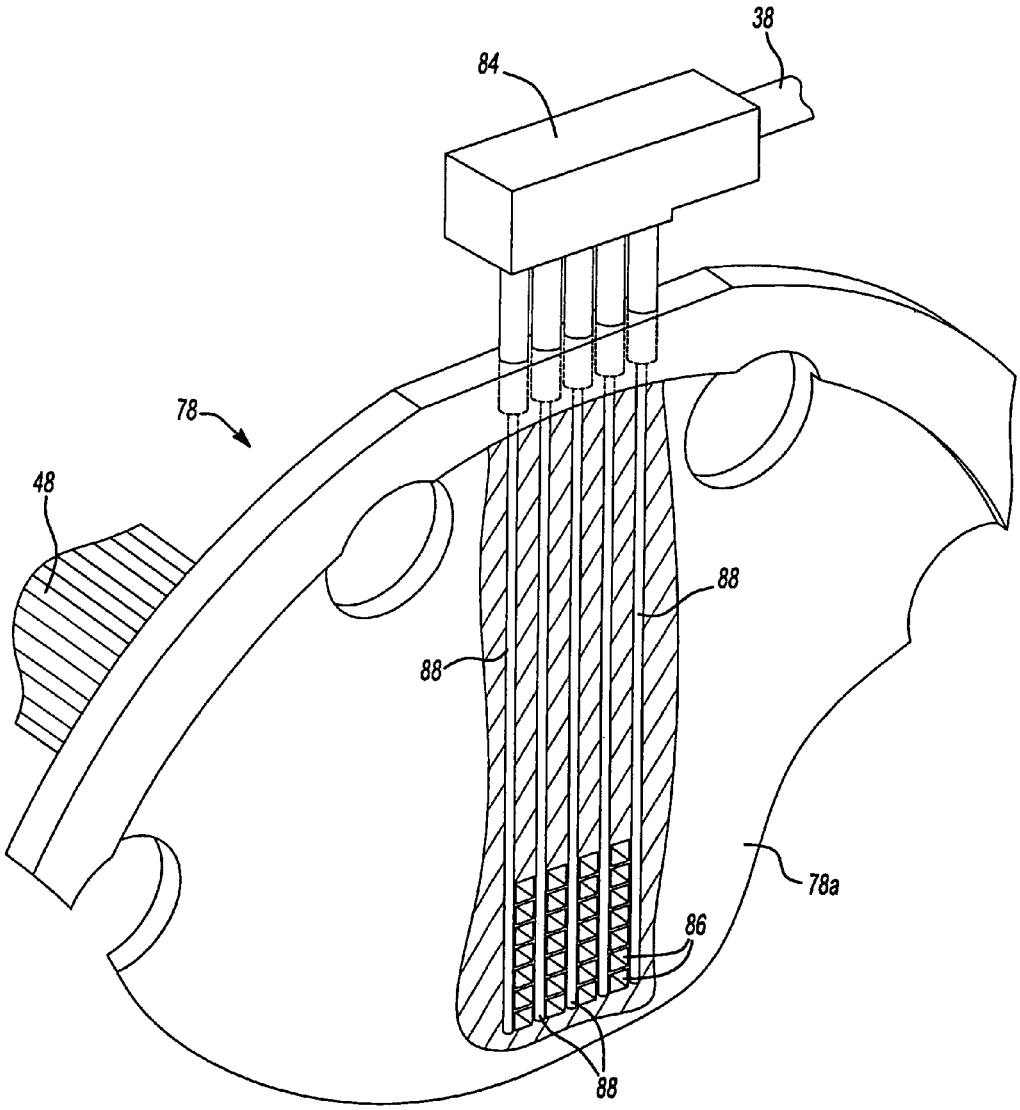
FIG. 6 is a detailed partial cross-sectional perspective view of an injector plate according to an alternative embodiment.

With continuing reference to FIG. 5 and additional reference to FIG. 6, where in FIG. 6 the outer portion of the combustor 70 has been removed to illustrate in detail the main injector plate 78. The main injector plate 78 defines a plurality of oxidizer pathways 86 through which the heated oxidizer flows from the heat exchange tubes 48. The heated oxidizer flows into the main combustion area 76 which is defined as the area downstream of the downstream face 78*a* of the main injector plate 78. Fuel is provided to the areas between the oxidizer pathways 86 through a plurality of injector plate fuel pathways 88. The main injector plate fuel pathways 88 extend from the fuel supply port 84 to the areas between the oxidizer pathway 86 to injectors or an injector element 90, as described herein.

With continuing reference to FIG. 6, the main injector plate 78 defines a plurality of the main injector plate fuel pathways 88 such that fuel may be provided to each of a plurality of areas between the oxidizer pathways 86. The main injector plate 78 defines a thickness appropriate to supply the fuel to the injection areas. The thickness of the main injector plate 78 may be any appropriate thickness to meet various requirements. Nevertheless, the main injector plate 78 provides the final pathway for the fuel as it flows to the injector areas to be injected into the combustion area 76.

Because the fuel supply port 84 is interconnected with the main injector plate 78, the main fuel line 38 may be disconnected and the main injector plate 78 removed from the combustor assembly 70. This may be done for any appropriate reason, such as cleaning the injectors in the main injector plate 78, changing the injectors in the injector plate 78, or any other appropriate reason. Therefore, the heat exchange tubes 48 may not generally be fixed to the main injector plate 78, but rather fixed to a seal or second portion that is able to substantially seal with or engage the main injector plate 78 such that the oxidizer is provided in the appropriate area.

Figure 7:
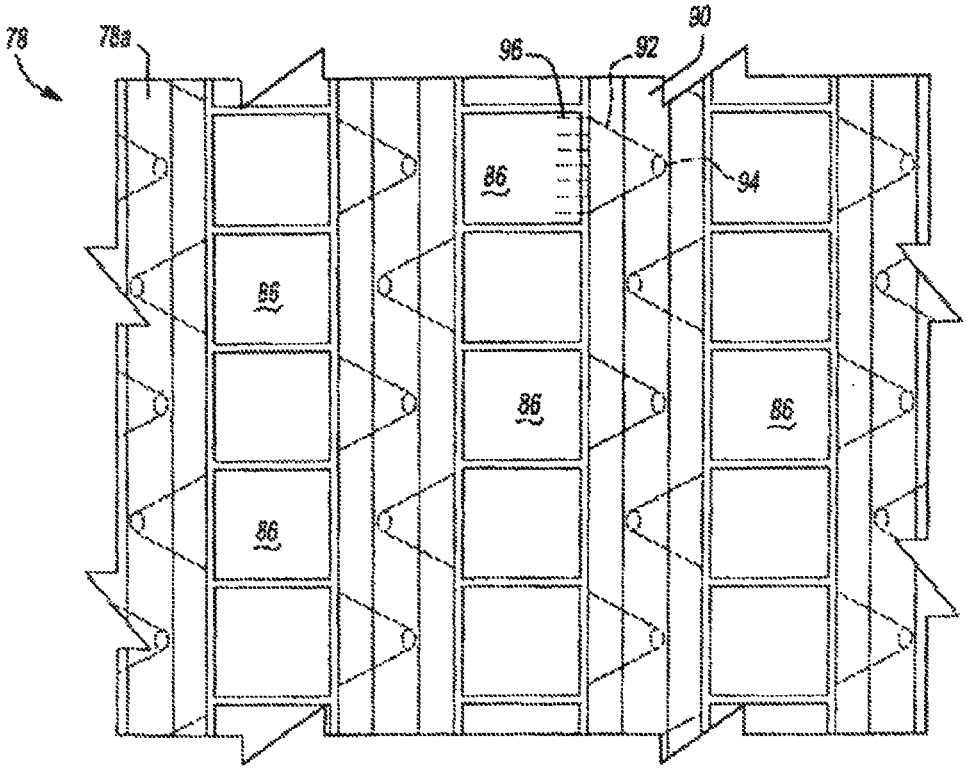
FIG. 7 is a front detailed view of the injector plate according to various embodiments.

With reference to FIG. 7, the main injector plate 78 defines the plurality of oxidizer pathways 86 relative to which a plurality of injectors in an injector element 90 is provided. The injector element 90 generally extends along a length that is provided near a plurality of the oxidizer pathways 86. Provided in the injector element 90 is an injector slot 92 that extends from an orifice 94. Fuel is provided from or through the injector orifice 94 to the injector slot 92. The slot 92, as described herein, assists in forming a fuel fan or fuel spray 96 relative to one of the oxidizer pathways 86. The injector element 90 may provide a plurality of the injector slots 92 and injector orifices 94 for each of the oxidizer pathways 86, or only one injector slot 92 per pathway 86 may be provided. Nevertheless, the injector element 90 is able to provide the fuel fan 96 to at least one of the selected oxidizer pathways 86.

Figure 8:
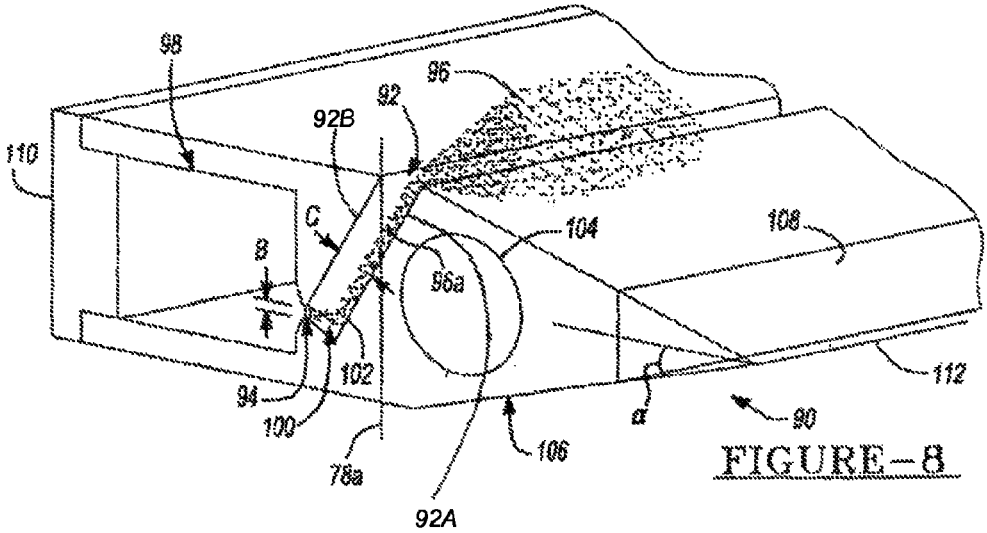
FIG. 8 is a perspective view of an injector element according to various embodiments.

With continuing reference to FIG. 7 and additional reference to FIG. 8, the injector element 90 generally includes a fuel feed cavity 98 through which the selected fuel is able to flow. Generally, the fuel feed cavity 98 is interconnected to at least one of the main injector plates fuel pathways 88 that are interconnected to the fuel port 84. Nevertheless, it will be understood that the injector element 90 may also be interconnected to the fuel path that provides the fuel through the combustor, such as the fuel path 38 illustrated in relationship to the combustor illustrated in FIG. 2. Therefore, the fuel may be provided to the fuel feed cavity 98 in any appropriate manner.

Once the fuel is provided to the fuel feed cavity 98 under a selected pressure, the fuel moves towards and through the injector orifice 94 into the injector slot 92. The fuel fan 96 is formed as a fuel jet 100 exits the orifice 94 from the fuel feed cavity 98. The fuel jet 100 generally engages a downstream splash plate 102 of the injector element 90 and is spread across the splash plate 102. As the fuel is spread across the splash plate 102, the fuel spreads out such that it exits the injector slot 92 in a substantially open or fanned form.

A coolant pathway 104 is provided through a nose or downstream end 106 of the injector element 90. In addition, the very tip or end of the nose 106 may be a substantially flat or planar surface 108, for reasons described herein. In addition, a removable plug 110 may be used to seal or close a selected side of the fuel feed cavity 98 such that the fuel feed cavity plug 110 may be easily removed for selected purposes.

With continued reference to FIG. 8, the injector orifice 94 may be any appropriate size, and may be about 0.001 to about 0.1 inches (about 0.254 mm to about 2.54 mm). The injector orifice 94, however, may be any appropriate size or shape. For example, the injector orifice 94 may be a selected geometrical shape, such as an octagon, or other appropriate polygon. In addition, the injector orifice 94 may be a slot substantially equal to the injector slot 92 provided in the injector element 90. Therefore, the injector orifice 94 need not simply be circular or round in shape and size, but may be any appropriate size to provide the fuel jet 100 through the injector orifice 94 to engage the splash plate 102. In addition, the length of the orifice 94 may be any appropriate length. Nevertheless, it may be provided to include a length to diameter ratio (L/D) of about zero to produce a substantially free jet of fuel 100. Therefore, the fuel jet 100 may nearly immediately impinge the splash plate 102 to form the fuel fan 96.

In addition, the injector slot 92 generally includes a first wall 92A and second wall 92B. Second wall 92B is generally parallel to the first wall 92A to define a width C that is not substantially filled by the pre-fuel fan 96*a*. The pre-fuel fan 96*a* formed within the slot 92 generally fills less than about 90% of the width C of the injector slot 92, but it may fill any appropriate amount of the width, such as about 10% of the width. According to various embodiments, the injector slot 92 width C may be greater than about 0.02 inches (about 0.508 mm). For example, when the fuel jet 100 exits the orifice 94, it is generally not greater than about 0.02 inches. The hydraulic diameter of the fuel jet 100 is about 0.005 inches to about 0.01 inches (about 0.127 mm to about 0.254 mm). Therefore, the fuel jet fills, according to this example, at most 50% of the injector slot 92.

With additional reference to FIG. 8, the coolant pathway 104 allows for active cooling of the injector element 90. As discussed above, the heated oxidizer exiting the heated oxidizer pathway 86 may be a temperature that is substantially the hypergolic temperature of the fuel that is in the fuel fan 96. Therefore, the injector element 90 may be heated during use. In addition, the fuel that is sprayed in the fuel fan 96 further combusts in the hypergolic oxidizer. Therefore, a coolant, such as any appropriate coolant including water, an organic coolant, or the like, may be provided through the coolant pathway 104 to assist in cooling the injector element 90 for increased longevity, decreased maintenance and other appropriate reasons.

The nose 106 of the injector element 90 generally tapers at a half angle $\alpha$ of about 2 to about 20 degrees. Generally the half angle $\alpha$ may assist in assuring that the heated oxidizer that exits the oxidizer pathways 86 does not form eddies or turbulence as the heated oxidizer passes the injector element 90. It may be optional to provide the planar portion 108 to form a flame holding area near the injector element 90 for selected reasons. Nevertheless, providing a substantially sharp or pointed nose area 112 (shown in phantom) may assist in assuring that the heated oxidizer passes the injector element 90 without forming a substantially flame holding area and that substantially no turbulence is formed near the injector element 90.

Figure 9:
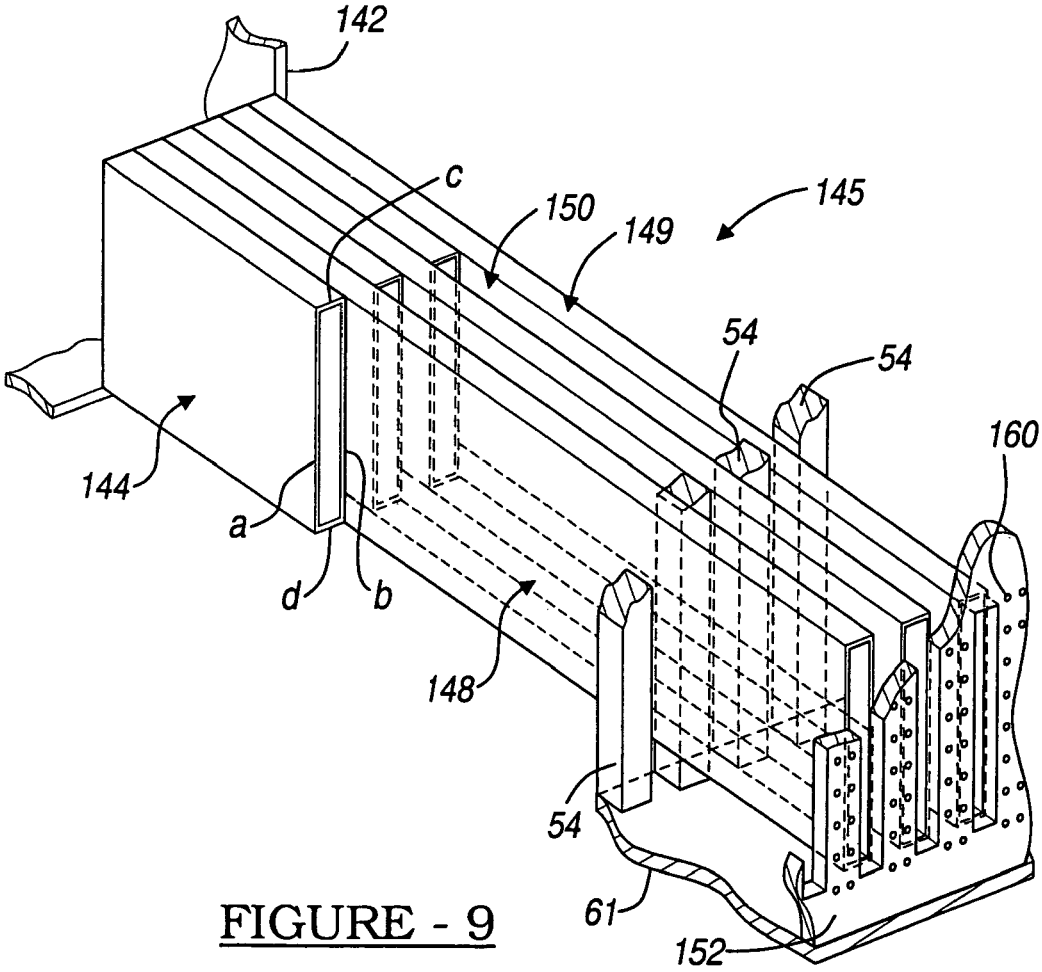
FIG. 9 is a detailed, partial cross-sectional, perspective view of a portion of the heat exchanger according to a second embodiment.

With continuing reference to FIGS. 8 and 9, the injector element 90 includes a plurality of the orifices 94 and the injector slots 92. As particularly illustrated in FIG. 7, the slots 92 may alternate on the injector element 90 such that the injector element 90 is able to provide the fuel fan 96 to an alternating one of the oxidizer pathways 86 on either side of the injector element 90. Although it will be understood that providing the alternating pathways is not necessary, this may provide a substantially efficient manner of providing fuel to each of the oxidizer pathways 86. Nevertheless, it will be understood that one injector slot 92 need not be provided to each of the oxidizer pathways 86. Rather, fuel may be provided through the injector slot 92 such that it expands to provide fuel to a plurality of the oxidizer pathways 86 rather than to only one of the oxidizer pathways 86.

As merely an example, and not intended to be limiting, the injector element 90 may provide a fuel fan 96 that has a velocity of about 180 to about 330 feet per second (about 54.86 meters per second to about 100.58 meters per second). Generally, this provides a sheet velocity exiting the injector orifice 92 of about 45 to about 80 feet per second (about 13.72 to about 24.38 meters per second) with a sheet thickness of approximately 0.005 inch to 0.010 inch (about 0.127 mm to about 0.254). Generally, the heated oxidizer that exits the oxidizer pathway 86 generally has velocity of about 200 to 300 feet per second (about 60.96 to about 91.44 meters per second). Therefore, it is expected that the fuel fan will first penetrate about 0.04 inches to about 0.06 inches (about 1.02 mm to about 1.524 mm) or about 40% of the width of an exemplary 0.125 inch (3.175 mm) oxidizer pathway 86. In addition, turbulent eddy diffusion may also cause the fuel jet to mix with the hot vitiated air stream. Calculations to determine the jet penetration distance and subsequent eddy diffusion fuel mixing times are generally known in the art such as those described in Rudinger, G., AIAA Journal 12 (No. 4) 566 (1974) and Williams, F. A., Combustion Theory, Addison-Wesley, Reading, Mass. (1965). With the above information, it may be expected that the fuel may be substantially mixed with the heated oxidizer in approximately 1 millisecond. Therefore, although merely exemplary, the injector element 90 is able to substantially mix fuel with the heated oxidizer that is emanating from the oxidizer pathway 86 before the fuel is able to reach the auto ignition temperature and combust. Therefore, the fuel will be able to substantially combust evenly across the face 78*a* of the injector plate 78 such that no substantial hot spots are created. Generally, substantial mixing before combustion may allow the fuel to combust evenly across the face 78*a* without the face exceeding selected temperatures below about 1700° F. (about 927° C.).

In addition, though not intended to be limited by the theory, the splash plate 102 may assist in flowing the fuel such that fans or sheets in addition to eddies are formed in the fuel fan 96 as it exits the injector element 90 to engage the hot oxidizer emanating from the oxidizer pathway 86. This may assist in assuring a substantially complete mixing of the fuel with the oxidizer emanating from the oxidizer pathway 86.

It will be understood that the above is exemplary for the fuel methane. It will be understood that the injector element 90 may also mix any other appropriate fuel with the heated oxidizer before the selected fuel substantially reaches its combustion temperature. Therefore, the injector element 90 may also mix other selected fuels such as hydrogen, Synthesis gas (i.e., any mixture of hydrogen and carbon monoxide gases), other carbon fuels and combinations thereof. That is, the injector element 90 may be used substantially unchanged to inject various fuels into the heated oxidizer stream such that the fuel will be combusted in a substantially uniform manner.

Alternatively, or in addition to heating the air before it enters the catalytic tubes 48, particularly at start-up, a fuel that may have a higher kinetic energy on the catalyst in the catalytic tubes 48 may be used at start-up to achieve a selected temperature of the catalytic tubes 48. For example, hydrogen gas may be used during start-up to power the gas power turbine 10. As discussed above, hydrogen may be the fuel that is selected to combust in the oxidizer. In addition, two fuels may be used during a single operating procedure to achieve a selected operating condition. For example, hydrogen alone may be used to initially heat the catalytic tubes 48 and achieve a selected operating temperature and then a mixture of hydrogen and other selected fuels such as methane may be used for continuous operation or as an intermediary to a pure hydrocarbon or other selected fuel.

Nevertheless, using the gaseous hydrogen as the start-up fuel increases the kinetic activity thereby decreasing the temperature that the catalytic tubes 48 must be at to achieve an optimum reaction of the fuel with the oxidizer. Because the hydrogen may be able to react at a lower temperature, yet optimally, with the catalyst in the catalytic tubes 48, the reaction may be able to heat the catalytic tubes 48 to a selected temperature that may be an optimal reaction temperature of a second fuel in the gas powered turbine 10. Therefore, a different fuel may be used during a start-up phase than a fuel used during a continuous operation or later phase. During the start-up phase, the catalytic tubes 48 are heated to a selected temperature to allow for the optimal operating conditions of the gas powered turbine 10.

The use of two fuels may be used with substantially little difficulty in a single system. For example, and not intended to limit the description, a selected fuel may be natural gas, which may be used as a general and operating fuel, while hydrogen gas may be used as a start-up fuel. During the start-up phase, the gaseous hydrogen may react with the other portions of the gas powered turbine 10 in a substantially similar manner as the natural gas. For example, the hydrogen may be able to mix with the hypergolic air by being injected through the main injector plate 52 in a manner such that the gaseous hydrogen does not produce results that are dissimilar to other selected fuels. For example, a fuels injection momentum, $G_f$(ft.-lbm/sec$_2$), at a given heating rate, is defined by the following equation:

$$G_f \propto \frac{\hat{M}_f}{P\Delta H_{c,f}{}^2} \tag{1}$$

where P is the main combustor compressor pressure (psi), $\hat{M}_f$ is the molecular weight of the fuel (grams/mol) and $\Delta H_{c,f}$ is the fuel's molar or of combustion (BTU/SCF).

The molecular weight and volumetric heating value of natural gas is approximately 16 g/mol and 920 BTU/SCF, respectively. For hydrogen, the molecular weight and volumetric heating value is about 2 g/mol and 300 BTU/SCF, respectively. Using Equation 1, at any given combustor pressure, the fuel momentum is substantially equivalent for the same excess air combustor firing rate. Therefore, the impingement jet mixture geometry may allow for proper mixing for either the natural gas or the hydrogen, so that they may be easily interchanged, such that either fuel may be used to achieve substantially the same results in the gas powered turbine 10.

Selected fuels may be substantially mixed with the heated oxidizer before the fuel combusts using the injector element 90. Fuels that have substantially equivalent fuel injection momentums, as defined by Equation 1, may be used in similar injectors without changing the injector geometry. Therefore, according to the example described above where natural gas and hydrogen have substantially similar injector momentums, the injector will mix the fuel in a substantially similar manner.

It will be understood, however, that not all combinations of fuels or possibilities may include substantially similar injector momentums. The injector momentum may be easily determined, with Equation 1 or similar calculations or experiments, and if the injector momentum is substantially similar between two fuels or a plurality of fuels, then the injector may not need to be changed or altered to achieve similar or selected mixing. This allows that the combustor 14 may be operated using a plurality of types of fuels without changing any of the physical attributes, such as the injectors, of the combustor 14. This would allow a turbine 10 to remain in operation regardless of the fuel supply being used or available to operate the combustor 14.

Thus, it will be understood that hydrogen need not simply be a start up fuel, and may be a fuel used to operate the combustor 14 during operation. That is a methane fuel source may be available at a certain point in the operating cycle of the combustor and/or a hydrogen fuel source is available during a different operating cycle of the combustor 14. Either of the fuels could be used to operate the combustor 14 without changing any of the portions of the combustor 14. Simply, different fuels may be run through the combustor 14.

This allows a substantial intermixing of the fuel with the air exiting the oxidizer pathways 86 before the fuel combusts so that the combustion in the combustion chamber 34, across the face of 52*a* of the main injector plate 52, is substantially even. This generally does not allow hot spots in the combustion area 34 to form, thereby substantially eliminating the production of NOX chemicals. It will be appreciated that in this embodiment, opposing fuel fans 92 are not necessary to provide an appropriate fuel plume 96. Because the injector port 90 produces a fuel fan 92 which is already substantially spread out and dispersed, the impingement of two fuel streams is not generally necessary.

As discussed above, the air that exits the heat exchanger 45 is at the auto-ignition or hypergolic temperature of the fuel used in the gas powered turbine 10. Therefore, as soon as the fuel reaches the temperature of the air, the fuel ignites. Since the fuel is thoroughly mixed with the air, the combustion of the fuel is nearly instantaneous and will not produce any localized or discrete hot spots. Because the fuel is so well mixed with the air exiting the heat exchanger 45, there is no one point or area which has more fuel than any other point, which could also create hot spots in the main combustion section 34. Therefore, the temperature of the air coming from the main injector 52 and into the main combustion section 34 is substantially uniform. During operation of the gas powered turbine 10, the fuel's characteristic mixing rate is faster than the combustion rate of the fuel.

The temperature of the air, after the additional fuel has been combusted from the main injector 52, is about 1315° C. to about 1538° C. (about 2400° F. to about 2800° F.). Preferably, the temperature, however, is not more than about 1426° C. (about 2600° F.). Different fuel to air ratios may be used to control the temperature in the main combustion section 34.

The main combustion section 34 directs the expanding gases into a transition tube (not shown) so that it engages the turbine fans 16 in the turbine area 15 at an appropriate cross sectional flow shape.

The use of the heat exchanger 45 raises the temperature of the air to create hot or heated air. The hot air allows the catalyst to combust the fuel that has been entrained in the air in the premix chamber 42 without the need for any other ignition sources. The catalyst only interacts with the hydrocarbon fuel and the oxygen in the air to combust the fuel without reacting or creating other chemical species. Therefore, the products of the combustion in the heat exchange tubes 48 are substantially only carbon dioxide and water due to the catalyst placed therein. No significant amounts of other chemical species are produced because of the use of the catalyst. Also, the use of the heat exchange tubes 48, with a catalyst disposed therein, allows the temperature of the air to reach the auto-ignition temperature of the fuel so that no additional ignition sources are necessary in the main combustion section 34. Therefore, the temperature of the air does not reach a temperature where extraneous species may be easily produced, such as NOX chemicals. Due to this, the emissions of the gas powered turbine 10 of the present invention has virtually no NOX emissions. That is, that the NOX emissions of the gas powered turbine 10 according to the present invention are generally below about 1 part per million volume dry gas.

Also, the use of the heat exchanger 45 eliminates the need for any other pre-burners to be used in the gas powered turbine 10. The heat exchanger 45 provides the thermal energy to the air so that the catalyst bed is at the proper temperature. Because of this, there are no other areas where extraneous or undesired chemical species may be produced. Additionally, the equivalence ratio of the premix area is generally between about 0.20 and 0.30, while the equivalence ratio of the main injector 52 is between about 0.50 and about 0.60. This means that the fuel combustion will occur as a lean mixture in both areas. Therefore, there is never an excessive amount of fuel that is not combusted. Also, the lean mixture helps to lower temperatures of the air to more easily control side reactions. It will be understood that different fuel ratios may be used to produce different temperatures. This may be necessary for different fuels.

With reference to FIG. 9, a detail portion of the combustor 14, similar to the portion illustrated in FIG. 3, according to various embodiments of a heat exchanger 145 is illustrated. A premix chamber 142 allows air from the compressor to be mixed with a first portion of fuel. Air comes from the compressor and travels through a cooling fin 144 rather than through a plurality of cooling tubes 44, as discussed above in relation to the first embodiment. It will be understood that exit ports may also be formed in the cooling fins 144 to form the premix area 142. The cooling fin 144 is defined by two substantially parallel plates 144*a* and 144*b*. It will be understood, however, that other portions, such as a top and a bottom will be included to enclose the cooling fin 144. Additionally, a heat exchange or catalyst fin 148 is provided rather than heat exchange tubes 48, as discussed above in the first embodiment. Again, the catalyst fin 148 is defined by side, top, and bottom walls and defines a column 149. Each catalyst column 149, however, is defined by a single catalyst fin 148 rather than a plurality of catalyst tubes 48, as discussed above. The cooling fin 144 may include a plurality of cooling fins 144. Each cooling fin 144, in the plurality, defines a cooling pathway. Similarly, the heat exchange fin 148 may include a plurality of heat exchange 148 fins. Each, or the plurality of, the heat exchange fins 148 defines a heat exchange or catalyst pathway.

Channels 150 are still provided between each of the catalyst fins 148 so that air may flow from the compressor through the cooling fins 144 into the premix chamber 142. Air is then premixed with a first portion of fuel and flows back through the catalyst fins 148 to the main injector plate 152. Injection ports 160 are provided on the main injector plate 152 to inject fuel as the air exits the catalyst fin 148. A suitable number of injector ports 160 are provided so that the appropriate amount of fuel is mixed with the air as it exits the catalyst fins 148. An intra-propellant plate 54 is also provided.

The injector ports 160 provided on the main injector plate 152 provide a fuel stream as heated air exits the oxidizer paths (not particularly shown) from the catalyst fins 148. Either of the previously described injector ports 60 or 90 may be used with the second embodiment of the heat exchanger 145 to provide a substantial mixing of the fuel with the air as it exits the catalyst fins 148. This still allows a substantial mixture of the fuel with the air as it exits the catalyst fins 148 before the fuel is able to reach its ignition temperature. Therefore, the temperatures across the face of the main injector 152 and in the combustion chamber 34 are still substantially constant without any hot spots where NOX chemicals might be produced.

It will also be understood that the cooling fins 144 may extend into the pre-mixer 142 similar to the cooling tubes 44. In addition, ports may be formed in the portion of the cooling fins 144 extending into the pre-mixer to turn all the air exiting the cooling fins and subsequently mix with a first portion of fuel. Therefore, the combustor according to the second embodiment may include a pre-mixer 142 substantially similar to the pre-mixer illustrated in FIG. 5, save that the ports are formed in the cooling fins 144 rather than individual cooling tubes 44. In addition, this alternative embodiment may include a combustion inhibitor to assist in eliminating combustion in the pre-mixer 142.

It will be further understood that the heat exchanger, according to the present disclosure, does not require the use of individually enclosed regions or modular portions. Rather the heat exchanger may be formed of a plurality sheets, such as corrugated sheets. A first set of these sheets are oriented relative to one another to form a plurality of columns. The first set of sheets include a catalyst coated on a side facing an associated sheet, such that the interior of the column includes the catalyst to contact the airflow. In this way, the catalyst need not be coated on the interior of a closed space, but rather the space is formed after the catalyst is coated to form the catalyst pathway. Operatively associate with the first set of sheets is a second set of sheets, defining a second set of columns disposed at least partially between the first set of columns. Thus, in a manner similar the heat exchanger 145, heat exchange columns and cooling columns are formed. These then form the catalyst pathway and the cooling pathway in operation of the combustor.

The present disclosure thus provides an apparatus and method that virtually or entirely eliminates the creation of NOX emissions. Advantageously, this is accomplished without significantly complicating the construction of the gas powered turbine 10 or the combustors 14.

The foregoing description is merely exemplary in nature and, thus, variations that do not depart from the gist of the disclosure are intended to be within the scope of the present disclosure. Such variations are not to be regarded as a departure from the spirit and scope of the present disclosure.

What is claimed is:

1. An injector for injecting a fuel into a fluid stream, the injector comprising:

an aperture in a wall defining a void which receives a fuel, said aperture generates a fuel jet as said fuel is forced through said aperture;

a slot formed in said injector and in communication with said aperture, said slot including a wall which forms a splash plate against which said fuel jet impinges, said splash plate transforms said fuel jet into a fan shape, said fuel jet has a hydraulic diameter less than about 80% of a width of said slot.

2. An injector for injecting a fuel into a fluid stream, the injector comprising:

an aperture in a wall defining a void which receives a fuel, said aperture generates a fuel jet as said fuel is forced through said aperture;

a slot formed in said injector and in communication with said aperture, said slot including a wall which forms a splash plate against which said fuel jet impinges, said splash plate transforms said fuel jet into a fan shape, said fuel jet has a hydraulic diameter no more than about 50% of a width of said slot.

3. An injector for injecting a fuel into a fluid stream, the injector comprising:

an aperture in a wall defining a void which receives a fuel, said aperture generates a fuel jet as said fuel is forced through said aperture;

a slot formed in said injector and in communication with said aperture, said slot including a wall forming a splash plate against which said fuel jet impinges, said splash plate transforming said fuel jet into a fan shape, said injector includes a nose portion downstream, relative to a flow director of said fuel through said injector, with said nose portion having a pair of generally planar converging surfaces.

4. The injector of claim 3, wherein said nose includes a pathway formed therein for flowing a coolant through said injector adjacent said slot.

5. An injector for injecting a fuel into a fluid stream, the injector comprising: a plurality of apertures in opposing walls to form a void that defines a flow path to receive a fuel and generate fuel jets flowing in opposite directions; and a slot formed in said injector and in communication with said apertures, said slot including a first wall forming a splash plate against which said fuel jets impinges, said splash plate transforming said fuel jets into a fan shape, said first wall and a second wall generally parallel to said first wall defines a width of said slot.

6. An injector for injecting a fuel into a fluid stream, the injector comprising:

an aperture in a wall defining a void which receives fuel, said aperture generates a fuel jet as said fuel is forced to flow through said aperture;

a slot formed in said injector and in communication with said aperture, said slot including a wall forming a splash plate against which said fuel jet impinges, said splash plate transforming said fuel jet into a fan shape;

an injector face defined by an injector plate; and an injector nose extending downstream of said injector face such that an oxidizer flows past said injector nose.

7. The injector of claim 6, wherein said injector nose includes an internal angle of about 4° to about 20°.

8. The injector of claim 6, wherein said injector nose defines a plane that allows a flow of the oxidizer past said injector nose substantially turbulence free.

9. An injector for injecting a fuel into a fluid stream, the injector comprising:

a void defining a flow path for receiving said fuel;

an aperture in a wall to define said void, said aperture operating to generate a fuel jet as said fuel is forced to flow through said aperture;

a slot formed in said injector and in communication with said aperture, said slot including a first wall forming a splash plate against which said fuel jet impinges, said splash plate transforming said fuel jet into a fan shape to produce a sheet flow of the fuel, said injector slot directs said sheet flow of fuel into a stream of oxidizer emanating from an oxidizer pathway wherein said sheet of fuel substantially mixes with said stream of oxidizer before any portion of the fuel combusts, said first wall and a second wall generally parallel to said first wall defines a width of said slot.

10. An injector for injecting a fuel into a fluid stream, the injector comprising:

a void defining a flow path for receiving a first fuel and a second fuel wherein said first fuel and said second fuel are different;

an aperture in a wall defining said void, said aperture operating to generate a fuel jet as said fuel is forced to flow through said aperture;

a slot formed in said injector and in communication with said aperture, said slot including a wall forming a splash plate against which said fuel jet impinges, said splash plate transforming said fuel jet into a fan shape.

11. The injector of claim 10, wherein:

said first fuel comprises at least one of hydrogen, methane, natural gas, Synthesis gas, and combinations thereof; and said second fuel comprises at least one of a hydrogen, a methane, a Synthesis gas, a natural gas, in combinations thereof.

* * * * *